US007316430B2

(12) United States Patent
Biester

(10) Patent No.: US 7,316,430 B2
(45) Date of Patent: Jan. 8, 2008

(54) CONNECTING MECHANISM

(75) Inventor: Klaus Biester, Wienhausen (DE)

(73) Assignee: Cameron International Corporation, Houston, TX (US)

( * ) Notice: Subject to any disclaimer, the term of this patent is extended or adjusted under 35 U.S.C. 154(b) by 265 days.

(21) Appl. No.: 10/525,934

(22) PCT Filed: Sep. 1, 2003

(86) PCT No.: PCT/EP03/09699

§ 371 (c)(1),
(2), (4) Date: Feb. 25, 2005

(87) PCT Pub. No.: WO2004/020781

PCT Pub. Date: Mar. 11, 2004

(65) Prior Publication Data

US 2006/0000599 A1 Jan. 5, 2006

(30) Foreign Application Priority Data

Aug. 30, 2002 (DE) ..... 202 13 388 U

(51) Int. Cl.
*F16L 25/00* (2006.01)

(52) U.S. Cl. ..... 285/394; 285/391; 285/920; 285/399; 166/338

(58) Field of Classification Search ..... 285/920, 285/922, 358, 394, 391, 399; 166/338, 340
See application file for complete search history.

(56) References Cited

U.S. PATENT DOCUMENTS 965,286 A * 7/1910 Ferguson ..... 285/34
1,831,956 A * 11/1931 Harrington ..... 277/326
3,251,611 A * 5/1966 Haeber et al. ..... 285/18
4,280,719 A 7/1981 Daniel et al.
2001/0011592 A1 8/2001 Baker

FOREIGN PATENT DOCUMENTS

GB 2 235 739 3/1991

* cited by examiner

*Primary Examiner*—David Bochna
(74) *Attorney, Agent, or Firm*—Conley Rose, P.C.

(57) ABSTRACT

A connecting mechanism for two parts, which are at least partially insertable into one another, presents a cam-operated component, which runs on bearings and which is adjustable between a passive and an active position, on the one part, for shifting a number of contact elements between a withdrawal and a contact position, whereby the contact elements, when in the contact position, mesh in a retaining indentation on the other part, and a driving device for the adjustment of the cam-operated component between the active and passive positions. In order to ensure a secure and stable connection of these parts, using simple design means without additional pre-stressing or restraining devices, even when the parts are only partially inserted into one another, the contact elements are arranged in two or more levels essentially parallel to the insertion direction of the two parts and the cam-operated component for shifting the contact elements between the withdrawal and contact positions is allocated to each level.

40 Claims, 2 Drawing Sheets

CONNECTING MECHANISM

CROSS-REFERENCE TO RELATED APPLICATIONS

This application is a National Phase entry of PCT Application No. PCT/EP2003/009699 filed 1 Sep. 2003 which claims priority to German Application No. 202 13 388.5 filed 30 Aug. 2002, both of which are incorporated herein by reference. This application is related to the following applications: PCT/EP2003/009701 filed 1 Sep. 2003 which claims priority to German Application No. 202 13 391.5 filed 30 Aug. 2003, PCT Application No. PCT/EP2003/009700 filed 1 Sep. 2003 which claims priority to German Application No. 202 13 393.1 filed 30 Aug. 2002; PCT Application No. PCT/EP2003/009698 filed 1 Sep. 2003 which claims priority to German Application No. 202 13 365.6 filed 30 Aug. 2002; PCT Application No. PCT/EP2003/009697 filed 1 Sep. 2003 which claims priority to German Application No. 202 13 389.3 filed 30 Aug. 2002, PCT Application No. PCT Application No. PCT/EP2003/009696 filed 1 Sep. 2003 which claims priority to German Application No. 202 13 364.8 filed 30 Aug. 2002; and U.S. application Ser. No. 10/836,559 filed 30 Apr. 2004, all of which are incorporated herein by reference.

STATEMENT REGARDING FEDERALLY SPONSORED RESEARCH OR DEVELOPMENT

Not applicable.

BACKGROUND OF THE INVENTION

The invention relates to a connecting mechanism for two parts, which are at least partially insertable into one another, with a cam-operated component, which runs on bearings on the one part and is adjustable between a passive and active position, for shifting a number of contact elements between a withdrawal and a contact position, whereby the contact elements, when in the contact position, mesh in a retaining indentation on the other part, and with a driving device for the adjustment of the cam-operated component between the active and passive positions.

Such a connecting mechanism is known from U.S. 2001/0011592 A1. The connecting mechanism serves, for example, but not exclusively, for the arrangement of an insertion part in a throttle element for the conveyance of gas or oil. By means of the connecting mechanism, the insertion part can be replaced quickly in case of wear or the like. In this case, the insertion part is arranged so that it is entirely in the other part, meaning in the housing of the throttle mechanism. For positioning the insertion part and holding it in place in the other part, a number of contact elements are shifted from a withdrawal position into a contact position. The shifting is done by means of a cam-operated component that adjustably runs on bearings between a passive and an active position. In the passive position, the contact elements are arranged in their return position and in the active position the contact elements are arranged in their contact position. For retaining the contact elements in their contact position, the insertion part has a retaining indentation, which, for example, can be formed as a positioning shoulder that runs at a slant. In order to adjust the cam-operated component between the passive and active positions, the connecting mechanism furthermore presents a driving device.

It is true that the previously mentioned connecting mechanism with insertion parts inserted entirely in a housing is easily used, and that the two parts that are insertable into one another are sufficiently fixed in position with respect to one another. In addition to a further guide for the inserted part in the other part, however, additional fastening devices are necessary in order to improve the way the two parts are fixed in position relative to one another in connection with the contact elements in the contact position. This requires a relatively large design effort and is essentially only implementable for parts that are entirely inserted into one another. For example, in order to insert two parts only partially into one another, further design measures must be taken with regard to the connecting mechanism according to U.S. 2001/0011592 A1, which measures require considerable design effort and which would raise the price of the connecting mechanism.

SUMMARY OF THE INVENTION

For this reason, the invention takes as a basis the object of improving a connecting mechanism of the type mentioned at the beginning, to the effect that, with simple design means without additional fastening or tightening devices, a secure and stable connection of parts is ensured even when these parts are only partially inserted into one another.

This object is solved by means of the features of claim 1.

According to the invention, appropriate contact elements are arranged in two or more levels, essentially parallel to the inserting direction of the two parts. In this way, the parts are held in place relative to one another not only along one level, meaning essentially linearly, but also in at least two levels, meaning essentially three-dimensionally. Furthermore, due to the arrangement of the contact elements in the different levels, an interlocking or pre-stressing of the parts when inserting them is achieved by means of only the contact elements themselves. At the same time, the adjustment of the contact elements is achieved by the allocation of the corresponding cam-operated component to each level in which the contact elements are arranged.

The connecting mechanism according to the invention is particularly advantageous in those places where the corresponding parts are only partially inserted into one another and where appropriate securing and holding of the parts relative to one another should take place in the relatively small area in which the parts are inserted into one another. Possible applications for the connecting mechanism are, in addition to the complete insertion of one part into another (see U.S. 2001/0011592 A1), the connection, for example, of elements on an upper end of a stack of devices for the conveyance of gas or oil on the ocean floor or also on a platform with a riser or other devices leading away from this stack.

The connecting mechanism according to the invention can be especially advantageously used when the parts that can be inserted into one another are tubular. Preferably, the tubular parts are equipped with a circular cross-section at the same time.

In order to be able to arrange the connecting mechanism on one or the other part without separate built-on parts, if possible, the connecting mechanism can be arranged in the interior of the one part, particularly in its wall, whereby at least one end of the other part can be inserted into a longitudinal bore hole in the first part. With tubular parts, the connecting mechanism is arranged around the centered longitudinal bore hole in this connection.

In order to implement an adjustment of the cam-operated component in a simple way, the cam-operated component can present at least one rotating cam ring, running on bearings, with sliding cams on an inner surface of the ring. It is also possible for the sliding cams to be arranged on an outer ring surface of the cam ring, so that the contact elements can be shifted radially towards the outside. This is especially advantageous when the part formed with the cam-operated component is slid into the other part.

In order to shift the contact elements arranged in the different levels between the withdrawal and contact positions, one cam-operated component or cam ring can be satisfactory. With the appropriate rotation of the cam ring, the contact elements are then correspondingly shifted in all levels. There is, however, also the possibility of allocating one cam ring to each level of contact elements. In this case, if there were wearing, for example, it would be necessary to replace only one cam ring allocated to one level, by means of which the maintenance is simplified and made more economical.

To support the contact elements in such a way that they can be easily shifted between the withdrawal and the contact positions, the contact elements can be correspondingly kept on bearings in a supporting ring so that they are adjustable.

At the same time, the supporting ring can extend in the length direction of the part so far that it holds the contact components that are arranged in the different levels.

In any case, it is also possible, in connection with the supporting ring, that one supporting ring is allocated to each level. In different embodiments of the connecting mechanism according to the invention, it is possible, for example, for only one cam ring to adjust contact elements in different supporting rings, for more than one cam ring to adjust contact elements in more than one supporting ring and, furthermore, it is also possible for more than one cam ring to move contact elements arranged in one supporting ring in more than one level.

In order to form the appropriate sliding cams on the cam-operated component in a simple way, the sliding cams can be formed on the inner surface of the ring as a link guide.

It is possible for the different contact elements to be restrictedly guided by the sliding cams or the link guide, which means that an essentially physical connection exists between them. With another embodiment, which distinguishes itself particularly because of its simple design and improved maintenance possibilities, the contact element, with a particularly rotatable locating element that runs on bearings, can make contact on the inner surface of the ring of the cam-operated component or of the cam ring. In this way, when the cam ring is twisted, the locating element moves along the corresponding sliding cams or the link guide, and accordingly, because of this contact, the displacement of the contact element between the withdrawal and the contact positions take place.

In order to ensure in a simple way that the locating element lies against the sliding cams or the link guide or that the contact element lies against the sliding cams by means of the link guide, the contact element can be force- and, in particular, spring-pressurized in the direction of the withdrawal position. In this way, the contact element is always pressed in the direction of the cam-operated component, so that it is ensured that it is arranged in the withdrawal position with the appropriate rotation position of the cam-operated component.

Due to the arrangement of the contact elements in different levels, there furthermore is the possibility, for example, to react in a very simple way to the different dimensions of the other part or to allow different meshing capabilities of the contact elements in the corresponding retaining grooves in the longitudinal direction of the components or also in the circumferential direction of the components. In particular, this can occur when the contact elements present different levels and/or contact positions that are shifted radially inward, by different widths, in at least one level.

In order to further stabilize the connection between the parts, the contact elements of different levels can be arranged offset to one another in the circumferential direction.

In order to keep the cam rings and, where appropriate, also the supporting rings at a distance and to ensure concentric running of the cam rings, in particular, in a simple way, pivot bearings, in particular, ball bearings, can be arranged between adjacent cam rings.

In order to determine, in a simple way, the passive and active positions of the cam-operated component or the different cam rings, the cam-operated component or the cam ring can present a guide slot running in the direction of rotation, where its ends essentially determine the passive and active positions.

There are different possibilities for allowing the twisting of the cam ring or of the cam-operated component by means of the appropriate driving device. One simple possibility can be seen if the cam ring presents gearing along at least one part of an outside circumference, with which gearing a pinion, rotatable by the driving device, meshes. In this connection, it is possible that even when there are a number of cam rings, all can be twisted at the same time by an appropriately formed pinion. If the cam rings are to be twisted between the passive and active positions in different directions, however, or, for example, if it should be possible to select whether a different number of cam rings should be twisted, each cam ring can be driven separately.

The driving device can be operated by an appropriate pressure medium, so that corresponding pneumatic or hydraulic lines are additionally arranged for the supply of the driving device. In a simple embodiment, which requires relatively little design effort to supply the driving device while simultaneously allowing controlling the driving device in a simple way, the driving device presents at least one electric motor, whose driven shaft has a driving connection to the pinion or pinions. Additional driven devices can be provided, for example, in order to drive a pinion or more than one pinion via the driven shaft, in order to drive different pinions in different directions, or also in order to drive all pinions in the same rotational direction.

For reasons of redundancy or also in order to be able to use relatively small, and therefore not as powerful, electric motors, several electric motors can be allocated to each driven shaft. In a simple arrangement, the driven shaft extends across all electric motors, so that, for example, these can turn the driven shaft separately or also synchronously controlled.

For reasons of redundancy and also in order to realize appropriate power even when relatively low-powered electric motors are used, it is also possible for at least two driven shafts with one or more electric motors to be arranged at a distance from one another in the circumferential direction of the cam rings. With two driven shafts, these are advantageously arranged diametrically opposite one another with respect to the longitudinal bore hole of the one part. With three or more driven shafts, these are correspondingly arranged at equal distances apart in the circumferential direction. At the same time, the driven shafts can be mechanically coupled in their rotational movements.

It is still noted that, when, for example, one or two driven shafts are used, it is also possible for additional idle pinions to be arranged in the circumferential direction to the cam rings, which, while meshed with the gearing of the cam rings, are not themselves driven, however, but which instead essentially only serve the lateral support of the cam rings.

In order to drive the cam rings separately in a simple way, pinions with driving connections to different driven shafts can mesh with different cam rings. In this way, for example, it is possible to do without corresponding coupling devices if the cam rings are to be driven at different times, at different speeds, with different directions of rotation and the like.

It is true that usually the rotational speeds of the electric motors are adjustable. However, in order to realize an appropriate gear reduction for the rotation of the cam rings in a simple way, a step-down gear unit, in particular a so-called harmonic drive, can be arranged between the driven shaft and the pinion.

In order to ensure the connection of the parts that can be inserted into one another even when the parts are not accurately aligned and, simultaneously, to realize a certain interlocking of the connection even with contact elements that are arranged in only one level, it is possible for the contact element to present a concavely curved inner surface and/or to be formed essentially in a wedge-shape in the direction radially towards the inside, relative to the supporting ring. Because of the concave curvature, an essentially plane contact with the part to be attached occurs, and because of the wedge shape, simplified insertion in the corresponding retaining indentation occurs, as well as a certain interlocking of the connection, for example, in order to ensure a connection of the two parts relative to one another that is relatively simple and without play.

In order to be able to arrange the driving device, in particular, on the one part simply, the one part can present at least one retainer bore hole for the driving device in its wall, on its insertion end for the other part. In this retainer bore hole, which can also be formed in a ring shape, at least the driven shaft with the electric motor(s) and, where appropriate, also the step-down gear unit are inserted. Naturally, it is also possible for the pinions, the cam rings and the supporting rings to be accommodated and supported in this retainer bore hole.

However, in order to simplify the accessibility of the parts outside of the actual drive mechanism, the wall on the insertion end can present a ring clearance zone on the inside, in which a sleeve is detachably attached, which is formed at least for the rotatable support of the cam rings and the support of the supporting rings.

In order to simplify the allocation of the parts that are to be inserted into one another, the retaining indentation in the other part can be formed as a surrounding snap ring groove. In this way, it is ensured that a secure meshing of the contact elements in the retaining indentation is always possible, even with differing orientations of the parts to one another.

The insertion of the contact elements into the retaining indentation can furthermore be simplified by means of expanding the retaining indentation in the other part, in the direction of the contact element.

Different shapes are conceivable for the realization of the contact elements. The contact elements can, for example, be finger-shaped or the like. Likewise, it is possible for the contact elements to be formed so that they are essentially claw- or latch-shaped.

In order to support the cam rings, particularly in the area of the pinions, meaning the transmission of the driving power, two pivot bearings can be allocated for each bearing shaft with a driving connection to the driven shaft for the pinion(s), one on each side of it, in the circumferential direction of the cam rings.

Should there be a requirement to monitor parts of the drive mechanism with regard to their position, the position of the driven shaft and/or bearing shaft and/or pinion and/or cam ring and/or contact element can be registered by means of a position sensor.

BRIEF DESCRIPTION OF THE DRAWINGS

An advantageous embodiment of the invention is explained in more detail using the figures included with the drawing. Shown are.

DESCRIPTION OF THE PREFERRED EMBODIMENTS

Figure 1:
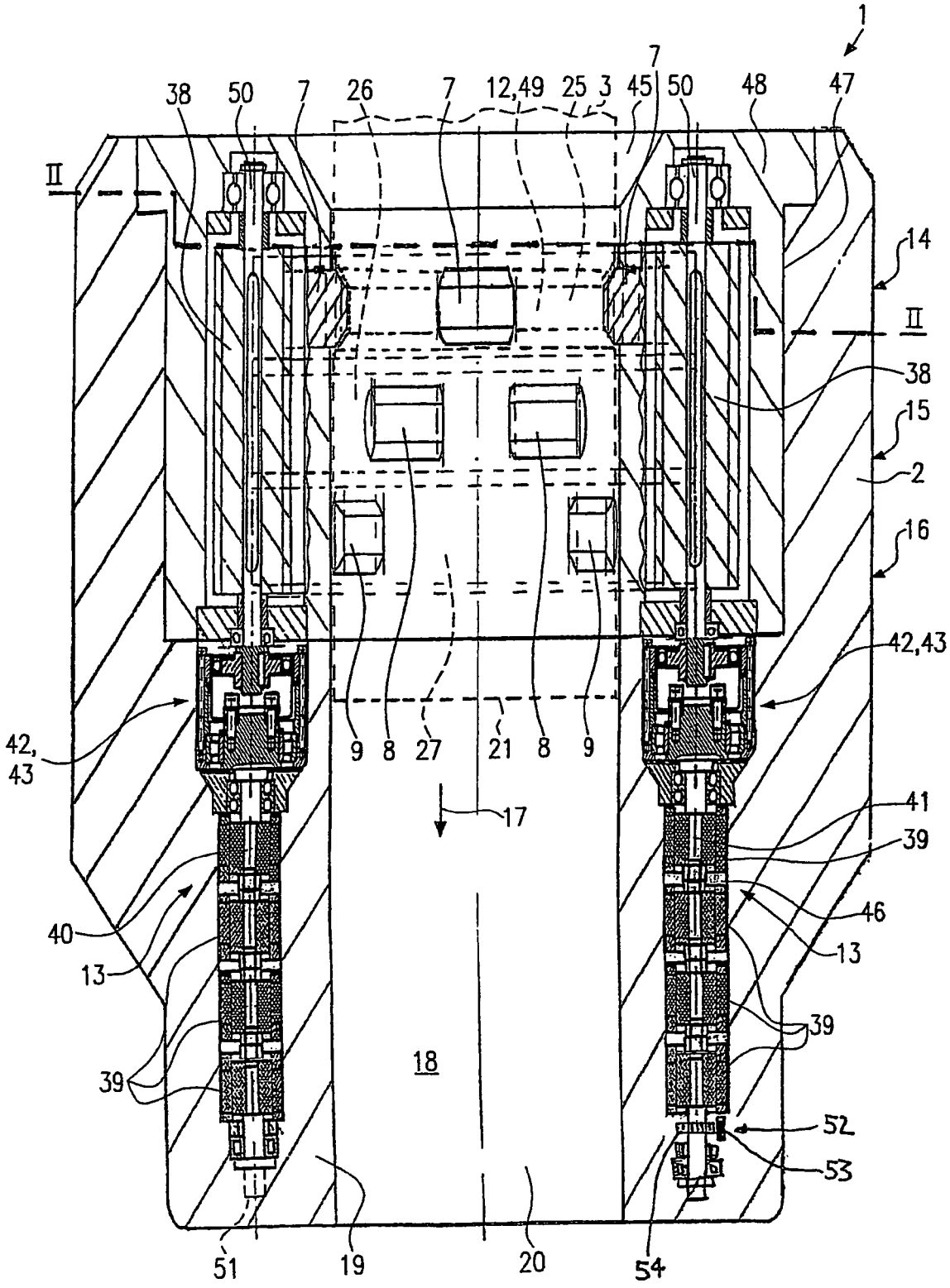
FIG. 1 shows a cut along line I-I from FIG. 2 of an embodiment of a connecting mechanism according to the invention and FIG. 2 shows a cut along the line II-II from FIG. 1.
Figure 2:
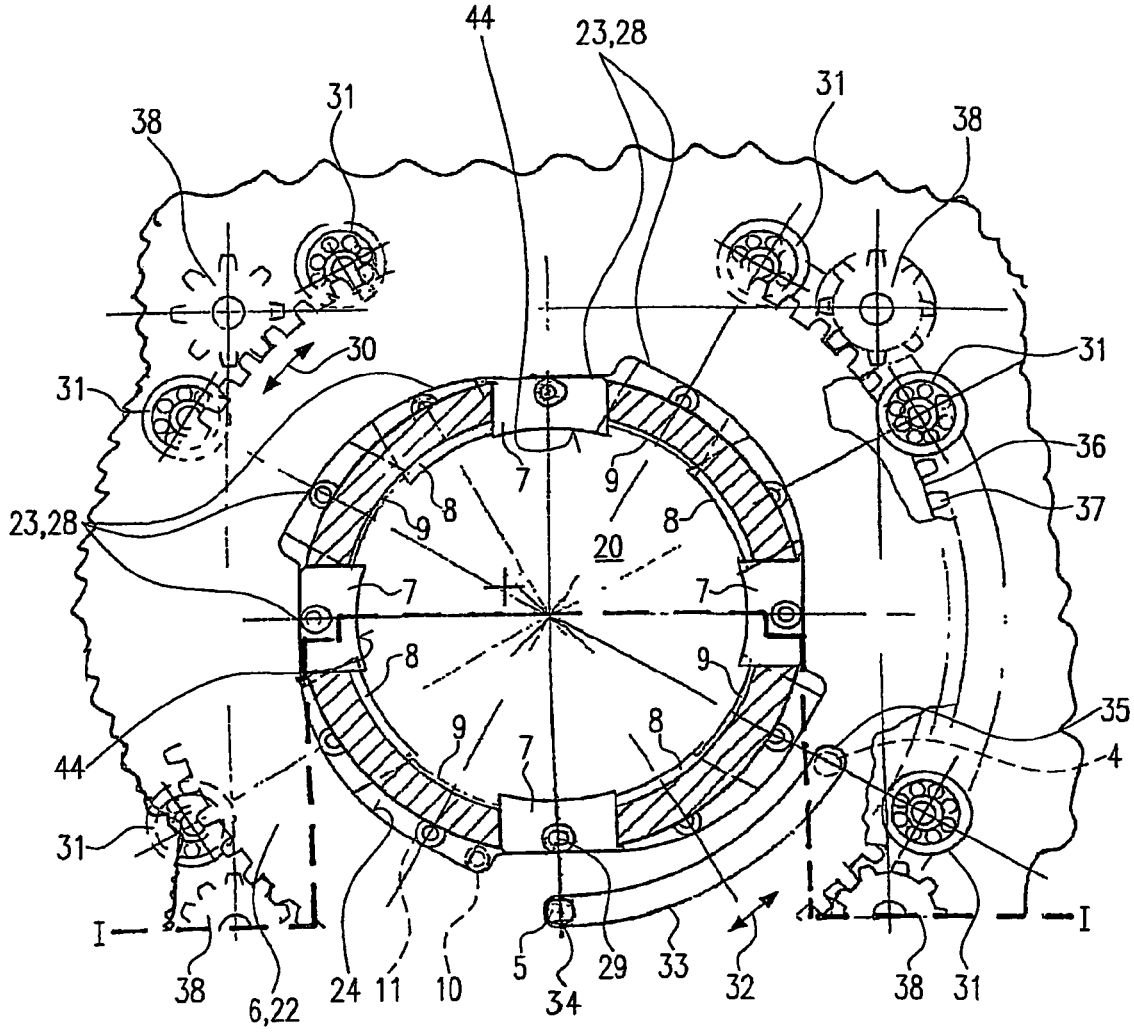

FIG. 1 shows an embodiment of a connecting mechanism 1 according to the invention with a cut along the line I-I from FIG. 2. The connecting mechanism 1 is held in a tubular part 2, which, for example, can bring about a connection from an upper end of a stack of BOPs (blowout preventers) to a so-called riser.

The tubular part 2 presents a longitudinal bore hole 20, in which a tubular second part 3 can be inserted from an insertion end 45. The other part 3 is inserted into part 2 so far that it is arranged with its free end 21 roughly in the center of part 2 according to FIG. 1.

In a wall 19 of part 2, in the embodiment shown, four retainer bore holes 46 are formed in which driving devices 13 are inserted. The retainer bore holes 46 can also be formed from an annulus.

Above the retainer bore hole 46, part 2 presents a ring clearance zone 47, which is open towards the longitudinal bore hole 20. An insertion sleeve 48 is detachably placed in this. In particular, this serves for the support of bearing shafts 50, which have a driving connection with the driving device 13.

The insertion sleeve 48 likewise presents an internal bore hole that continues the longitudinal bore hole 20, which is expanded towards the outside on the upper end, meaning the insertion end 45 of part 2.

The driving devices 13 in the embodiment shown are formed by four electric motors 39 arranged on a driven shaft 40, 41. The corresponding driven shaft 40, 41 is connected to the corresponding bearing shafts 50 over a step-down gear unit 42, which is formed as a so-called harmonic drive 43. Such a harmonic drive 43 is known in itself, and includes at least one stationary ring with internal gearing, a flexible sleeve with external gearing and with a driving connection to the driven shaft 40, 41 in the embodiment shown, as well as a shaft generator with a driving connection to the bearing shafts 50.

One or more pinions 38 are arranged on the corresponding bearing shaft 50 (see FIG. 2 as well). These are meshed with an external gearing 37 on the outside circumference 36 of cam rings 22 as the cam-operated component 6. A total of three cam rings 22 are arranged, whereby each cam ring presents corresponding sliding cams 23 or a link guide 28 on the inner surface of its ring 24, see FIG. 2 as well, by means of which the contact elements 7, 8, 9 can be shifted between a withdrawal position 10 and a contact position 11. With regard to the withdrawal and contact positions of the contact elements, it must be noted that they are suggested in FIG. 2 for a contact element 9 and the accompanying cam ring.

Otherwise, all contact elements 7, 8, 9 are arranged in the contact position 11 in FIG. 2.

In FIG. 1, it is particularly shown for the contact elements 7 arranged in a level 14, that these engage in a retaining indentation 12, formed as a snap ring groove 49, on part 3. This applies in the same way for the contact elements 8 and 9 arranged in the levels 15 and 16. The different levels 14, 15 and 16 with contact elements 7, 8, 9 are essentially arranged so that they are parallel and vertical to the insertion direction 17, in which direction part 3 can be inserted into part 2. The contact elements 7, 8, 9 are formed so that they are essentially claw- or latch-shaped and, on their inner surface that radially faces inwards to the longitudinal bore hole 20, present a concave curvature, which essentially corresponds to a corresponding curvature of the snap ring groove 49. Furthermore, the contact elements 7, 8, 9 run wedge-shaped in the direction radially inward, whereby this wedge shape is essentially complementary to the shape of the snap ring groove 49 (see FIG. 1 in level 14).

The contact elements 7, 8, 9 adjustably run on bearings in levels 14, 15 and 16 between their contact position 11 and their withdrawal position 10, in different supporting rings 25, 26, 27. At the same time, the contact elements are force- and, in particular, spring-pressurized in the direction of the withdrawal position 10. Because of this pressurization, the contact elements 7, 8, 9 make contact on the usually rotatable locating elements 29 with an inner surface of the ring 24 (see FIG. 2) of the cam rings 22, whereby the corresponding sliding cams 23 or the link guide 28 is formed on this inner surface of the ring 24.

FIG. 2 corresponds to a cut along the line II-II through FIG. 1. In FIG. 2, it is particularly evident that the contact elements 7, 8, 9 of the different levels 14, 15, 16 or the supporting rings 25, 26, 27 stand out at different distances radially toward the inside in the direction of the interior 18 of the longitudinal bore holes 20 of part 2. This is possible because of the different link guides 28 or sliding cams 23 of the cam rings 22.

Each cam ring 22 presents gearing 37 on its outside circumference 36, which is meshed with the pinions 38. Pivot bearings 31, formed as ball bearings, are arranged on both sides of each pinion 38, which pivot bearings are arranged between the different cam rings 22 to maintain an appropriate distance and to ensure concentric running of the cam rings. Depending on the direction of rotation of the driving devices 13, the cam rings 22 rotate in the circumferential direction 30 or direction of rotation 32. The driving devices are evenly spaced in the circumferential direction 30 and, where appropriate, arranged so that they are offset to one another.

In FIG. 1, a mechanical coupling device 52 is shown for a further embodiment of the connecting mechanism according to the invention, which device mechanically couples the rotational movements of the driven shafts 40, 41. In this way, a corresponding synchronous rotation of the driven shafts 40, 41, as well as any additional driven shafts that may be present, is ensured. In the embodiment shown, the mechanical coupling device 52 is formed by a toothed wheel or pinion 54 arranged on the corresponding driven shafts and a chain 53 that is meshed with it. The mechanical connection of the different pinions 54 on the driven shafts is made over the chain 54.

Likewise, the mechanical coupling device 52 can be formed from pinions with a toothed belt or as a gear set.

A corresponding mechanical coupling device 52 on the other driven shaft 14 is not shown, in the interest of simplification.

In FIG. 2, the contact elements 7 of level 14 or of the supporting ring 25 are visible, while the contact elements 8, 9 of levels 15, 16 or supporting rings 26, 27 are arranged lying below them. It is furthermore evident that the contact elements 7 of level 14 project the farthest in their contact position 11 radially towards the inside in the direction of the longitudinal bore hole 20, whereby this projection decreases up until the contact elements 9 of level 16. Furthermore, it is possible for the contact elements 7, 8, 9 also to project at different distances radially towards the inside in the direction of the longitudinal bore hole 20 in their respective levels 14, 15, 16.

The adjustment of the cam-operated component 6 or the individual cam rings 22 between the passive and active positions 4, 5 is determined by a guiding cut 33 that runs in the direction of rotation 22. If a pin or similar object that engages in the guide slot 33 is in contact with the end 34 of the guide slot 33, the corresponding cam ring 22 is in its active position 5. If instead, this pin is in contact with the other end 35, the corresponding cam ring is in its passive position 4.

In the following, the functional mode of the connecting mechanism according to the invention is briefly explained using the figures.

After the insertion of a tubular part 1 into the similarly essentially tubular part 2, a quick-disconnect connection is made between these parts by operating the driving devices 13 in such a way that the cam rings 22 are twisted into their active position 5 via the corresponding bearing shafts 50 and pinions 38. In this active position 5, the contact elements 7, 8, 9 in the levels 14, 15, 16 are radially shifted towards the inside, from their withdrawal position 10 into their contact position 11, by the corresponding link guides 28 or sliding cams 23 on the inner ring surface 24 of the cam rings 22. In these contact positions 11, the contact elements 7, 8, 9 engage in the corresponding retaining indentations 12, formed as snap ring grooves 49, of part 3. By using the electric motors for the driving device 13, the connecting mechanism is entirely electrified and can be easily operated by remote control. At the same time, the adjustment of the driving device can be measured by means of the corresponding position sensors 51 (see FIG. 1), whereby, however, it is also possible to allocate such position sensors 51 to the driven shaft 40, 41, the bearing shafts 50, the pinions 38, the cam rings 22 or, where appropriate, also to the contact elements 7, 8, 9.

If the connection of parts 2 and 3 should be disconnected again quickly, the driving device is simply operated in the reverse direction, so that, similarly, the cam rings 22 are turned back to their passive position 4 and the contact elements 7, 8, 9 move into their withdrawal positions 10. In this way, they no longer mesh with the corresponding retaining indentations 12 of part 3, and part 3 can easily be pulled out of part 2.

It is still noted that the connecting mechanism according to the invention can be used not only for the connection of two tubular parts 2, 3, but also for holding in place or connecting other parts, whereby (see the explanations at the beginning) complete insertion of a part in a housing, such as a valve, a choke or the like, can similarly take place, and this inserted part is held in place and position by the connecting mechanism according to the invention.

The invention claimed is:

1. Connecting mechanism comprising:

one part and another part, the another part being at least partially insertable into the one part, the one part having a cam-operated component which runs on bearings on the one part and is adjustable between a passive and an active position for shifting a first and a second plurality of contact elements between a withdrawal and a contact position, the first plurality of contact elements being separate from the second plurality of contact elements;

the first and second plurality of contact elements, when in the contact position, meshing in first and second retaining indentations on the another part;

a driving device to adjust the cam-operated component between the active and passive position;

the first plurality of contact elements being located at one level in the one part and the second plurality of contact elements being located at a second level in the one part, the contact elements being essentially parallel to the insertion direction of the two parts; and the cam-operated component shifting the contact elements between the withdrawal and contact positions located at each level.

2. Connecting mechanism according to claim 1, characterized in that the one and another parts are tubular.

3. Connecting mechanism according to claim 1, characterized in that the mechanism is arranged in the interior of the one part, whereby the another part can be inserted, with at least one end, into a longitudinal bore hole of the one part.

4. Connecting mechanism according to claim 1, characterized in that the cam-operated component presents at least one cam ring, rotatably running on bearings, with sliding cams on an inner surface of the ring.

5. Connecting mechanism according to claim 1, characterized in that a cam ring is allocated at each level of contact elements.

6. Connecting mechanism according to claim 1, characterized in that the contact elements run in bearings in a supporting ring and are adjustable between the withdrawal and contact positions.

7. Connecting mechanism according to claim 1, characterized in that a supporting ring is allocated at each level.

8. Connecting mechanism according to claim 1, characterized in that sliding cams are formed on the inner surface of the ring as a link guide.

9. Connecting mechanism according to claim 1, characterized in that the contact elements of different levels present contact positions that are shifted in different amounts, at least radially towards the interior.

10. Connecting mechanism according to claim 1, characterized in that the contact elements of one level present contact positions that are shifted at least in different amounts radially towards the interior.

11. Connecting mechanism according to claim 1, characterized in that the contact element presents a concave curved inner surface and/or is formed essentially wedge-shaped running in the direction radially inwards relative to a supporting ring.

12. Connecting mechanism according to claim 1, characterized in that the retaining indentation in the another part is enlarged radially.

13. Connecting mechanism according to claim 1, characterized in that the contact element is essentially formed so that it is claw-shaped or latch-shaped.

14. Connecting mechanism for two parts, which are at least partially insertable into one another, with a cam-operated component, which runs on bearings on the one part and is adjustable between a passive and active position for shifting a number of contact elements between a withdrawal and a contact position, whereby the contact elements, when in the contact position, mesh in a retaining indentation on the other part, and with a driving device for the adjustment of the cam-operated component between the active and passive position, characterised in that the contact elements are allocated in two or more levels essentially parallel to the insertion direction of the two parts and the cam-operated component for shifting the contact elements between the withdrawal and contact positions is allocated to each level;

the cam-operated component having at least one cam ring, rotatably running on bearings, with sliding cams on an inner surface of the ring; and the contact element, with a rotatable locating element that runs on bearings, is in contact with the inner surface of the ring.

15. Connecting mechanism for two parts, which are at least partially insertable into one another, with a cam-operated component, which runs on bearings on the one part and is adjustable between a passive and active position for shifting a number of contact elements between a withdrawal and a contact position, whereby the contact elements, when in the contact position, mesh in a retaining indentation on the other part, and with a driving device for the adjustment of the cam-operated component between the active and passive position, characterised in that the contact elements are allocated in two or more levels essentially parallel to the insertion direction of the two parts and the cam-operated component for shifting the contact elements between the withdrawal and contact positions is allocated to each level; and a spring biasing force forcing the contact element in the direction of the withdrawal position.

16. Connecting mechanism for two parts, which are at least partially insertable into one another, with a cam-operated component, which runs on bearings on the one part and is adjustable between a passive and active position for shifting a number of contact elements between a withdrawal and a contact position, whereby the contact elements, when in the contact position, mesh in a retaining indentation on the other part, and with a driving device for the adjustment of the cam-operated component between the active and passive position, characterised in that the contact elements are allocated in two or more levels essentially parallel to the insertion direction of the two parts and the cam-operated component for shifting the contact elements between the withdrawal and contact positions is allocated to each level;

the contact elements of different levels being arranged offset to one another in the circumferential direction.

17. Connecting mechanism according to claim 16, characterized in that the cam-operated component includes a cam ring for each level of contact elements and pivot bearings are arranged between adjacent cam rings.

18. Connecting mechanism for two parts, which are at least partially insertable into one another, with a cam-operated component, which runs on bearings on the one part and is adjustable between a passive and active position for shifting a number of contact elements between a withdrawal and a contact position, whereby the contact elements, when in the contact position, mesh in a retaining indentation on the other part, and with a driving device for the adjustment of the cam-operated component between the active and passive position, characterised in that the contact elements are allocated in two or more levels essentially parallel to the insertion direction of the two parts and the cam-operated component for shifting the contact elements between the withdrawal and contact positions is allocated to each level;

the cam-operated component having a cam ring with a guide slot having first and second ends, the guide slot running in the direction of rotation, and the ends determining the passive and active positions of the cam ring.

19. Connecting mechanism according to claim 18, characterized in that the cam ring presents a gearing at least along one part of its outside circumference, the gearing meshing with a pinion that can be rotated by the driving device.

20. Connecting mechanism according to claim 19, further including a plurality of cam rings with each cam ring being driven separately.

21. Connecting mechanism according to claim 19, characterized in that the driving device presents at least one electric motor, whose driven shaft has a driving connection with the pinion.

22. Connecting mechanism according to claim 21, characterized in that a plurality of electric motors are allocated to the driven shaft.

23. Connecting mechanism according to claim 21, characterized in that two or more driven shafts with one or more electric motors are arranged in the circumferential direction of the cam ring at a distance from one another.

24. Connecting mechanism according to claim 21, characterized in that each of a plurality of pinions have a driving connection with one of a plurality of driven shafts that are meshed with a cam ring.

25. Connecting mechanism according to claim 24, characterized in that a step-down gear unit is arranged between the driven shaft and pinion.

26. Connecting mechanism for two parts, which are at least partially insertable into one another, with a cam-operated component, which runs on bearings on the one part and is adjustable between a passive and active position for shifting a number of contact elements between a withdrawal and a contact position, whereby the contact elements, when in the contact position, mesh in a retaining indentation on the other part, and with a driving device for the adjustment of the cam-operated component between the active and passive position, characterised in that the contact elements are allocated in two or more levels essentially parallel to the insertion direction of the two parts and the cam-operated component for shifting the contact elements between the withdrawal and contact positions is allocated to each level;

the one part having at least one retainer bore hole for the driving device in its wall and for the insertion end of the other part.

27. Connecting mechanism for two parts, which are at least partially insertable into one another, with a cam-operated component, which runs on bearings on the one part and is adjustable between a passive and active position for shifting a number of contact elements between a withdrawal and a contact position, whereby the contact elements, when in the contact position, mesh in a retaining indentation on the other part, and with a driving device for the adjustment of the cam-operated component between the active and passive position, characterised in that the contact elements are allocated in two or more levels essentially parallel to the insertion direction of the two parts and the cam-operated component for shifting the contact elements between the withdrawal and contact positions is allocated to each level;

a wall on an insertion end of the one part has an interior ring clearance zone, in which an insertion sleeve is attached in a way that it can be detached, which is formed at least for the rotatable support of a plurality of cam rings and for the support of a plurality of supporting rings.

28. Connecting mechanism for two parts, which are at least partially insertable into one another, with a cam-operated component, which runs on bearings on the one part and is adjustable between a passive and active position for shifting a number of contact elements between a withdrawal and a contact position, whereby the contact elements, when in the contact position, mesh in a retaining indentation on the other part, and with a driving device for the adjustment of the cam-operated component between the active and passive position, characterised in that the contact elements are allocated in two or more levels essentially parallel to the insertion direction of the two parts and the cam-operated component for shifting the contact elements between the withdrawal and contact positions is allocated to each level; and the retaining indentation in the other part being formed as a snap ring groove.

29. Connecting mechanism for two parts, which are at least partially insertable into one another, with a cam-operated component, which runs on bearings on the one part and is adjustable between a passive and active position for shifting a number of contact elements between a withdrawal and a contact position, whereby the contact elements, when in the contact position, mesh in a retaining indentation on the other part, and with a driving device for the adjustment of the cam-operated component between the active and passive position, characterised in that the contact elements are allocated in two or more levels essentially parallel to the insertion direction of the two parts and the cam-operated component for shifting the contact elements between the withdrawal and contact positions is allocated to each level;

wherein the driving device includes two pivot bearings arranged on each side of a bearing shaft that has a driving connection with a driven shaft for a pinion in the circumferential direction of a cam ring of the cam-operated component.

30. Connecting mechanism according to claim 29, characterized in that the position of the driven shaft and/or bearing shaft and/or pinion and/or cam ring and/or contact element can be registered by means of a position sensor.

31. Connecting mechanism for two parts, which are at least partially insertable into one another, with a cam-operated component, which runs on bearings on the one part and is adjustable between a passive and active position for shifting a number of contact elements between a withdrawal and a contact position, whereby the contact elements, when in the contact position, mesh in a retaining indentation on the other part, and with a driving device for the adjustment of the cam-operated component between the active and passive position, characterised in that the contact elements are allocated in two or more levels essentially parallel to the insertion direction of the two parts and the cam-operated component for shifting the contact elements between the withdrawal and contact positions is allocated to each level;

wherein the driving device includes a plurality of driven shaft mechanically synchronized in their rotational movements.

32. A connector of oilfield members, the connector comprising:

a first member insertable at least partially into a bore of another member, the bore having a height;

the first member having at least first and second annular grooves;

the another member having at least a first and a second plurality of contact elements, the first plurality of contact elements being separate from the second plurality of contact elements;

the first plurality of contact elements being radially movable at a first height in the bore and the second plurality of contact elements being radially movable at a second height in the bore; and at least one actuation member to move the first plurality of contact elements into the first annular groove and to move the second plurality of contact elements into the second annular groove whereby the first member is held three-dimensionally within the another member.

33. The connector of claim 32 wherein the first and second annular grooves have different diameters.

34. The connector of claim 32 further including stops to limit the actuation of the first and second plurality of contact elements into the first and second annular grooves.

35. The connector of claim 32 wherein the actuation member cams the first and second plurality of contact elements into the first and second annular grooves.

36. The connector of claim 32 further including a drive member to actuate the at least one actuation member.

37. The connector of claim 36 wherein the drive member is housed within the another member.

38. The connector of claim 36 wherein the drive member includes a motor rotating a pinion geared to the actuation member.

39. The connector of claim 38 wherein the actuation member includes at least one cam ring geared to the pinion to rotate with respect to the first and second plurality of contact members.

40. The connector of claim 32 further including a sleeve mounted within the bore of the another member, the first and second plurality of contact elements being movably mounted on the sleeve.

* * * * *